US006533535B2

(12) United States Patent
Thut

(10) Patent No.: US 6,533,535 B2
(45) Date of Patent: Mar. 18, 2003

(54) MOLTEN METAL PUMP WITH PROTECTED INLET

(76) Inventor: Bruno H. Thut, 16755 Park Circle Dr., Chagrin Falls, OH (US) 44023

( * ) Notice: Subject to any disclaimer, the term of this patent is extended or adjusted under 35 U.S.C. 154(b) by 0 days.

(21) Appl. No.: 09/827,727

(22) Filed: Apr. 6, 2001

(65) Prior Publication Data

US 2002/0146313 A1 Oct. 10, 2002

(51) Int. Cl.[7] ..... F04D 7/06

(52) U.S. Cl. ..... 415/1; 415/121.2; 415/204; 415/206

(58) Field of Search ..... 415/121.2, 204, 415/205, 206; 416/247 R; 417/423.9, 423.14, 424.1

(56) References Cited

U.S. PATENT DOCUMENTS

| | | | | |
|---|---|---|---|---|
| 1,865,918 A | | 7/1932 | Junkers | |
| 2,808,782 A | | 10/1957 | Thompson et al. | |
| 3,010,402 A | * | 11/1961 | King | 415/121.2 |
| 3,291,473 A | | 12/1966 | Sweeney et al. | |
| 3,724,831 A | * | 4/1973 | Huffman | 266/38 |
| 3,984,234 A | | 10/1976 | Claxton et al. | |
| 4,456,424 A | | 6/1984 | Arsoka | |
| 4,504,392 A | | 3/1985 | Groteke | |
| 4,518,424 A | | 5/1985 | Ormesher | |
| 4,743,428 A | | 5/1988 | McRae et al. | |
| 4,786,230 A | | 11/1988 | Thut | |
| 4,940,384 A | | 7/1990 | Amra et al. | |
| 5,078,572 A | | 1/1992 | Amra et al. | |
| 5,268,020 A | | 12/1993 | Claxton | |
| 5,286,163 A | | 2/1994 | Amra et al. | |
| 5,586,863 A | | 12/1996 | Gilbert et al. | |
| 5,597,289 A | | 1/1997 | Thut | |
| 5,622,481 A | | 4/1997 | Thut | |
| 5,634,770 A | | 6/1997 | Gilbert et al. | |
| 5,716,195 A | | 2/1998 | Thut | |
| 5,785,494 A | | 7/1998 | Vild et al. | |
| 5,842,832 A | | 12/1998 | Thut | |
| 6,019,576 A | | 2/2000 | Thut | |
| 6,071,074 A | * | 6/2000 | Morando | 415/26.1 |
| 6,152,691 A | | 11/2000 | Thut | |

* cited by examiner

*Primary Examiner*—Ninh Nguyen
(74) *Attorney, Agent, or Firm*—Watts, Hoffmann, Fisher & Heinke Co.

(57) ABSTRACT

An inlet protector or guard that prevents jamming and clogging of a molten metal pump. The guard includes a flat surface having a central opening that accepts a shaft of the molten metal pump. A wall extends from the periphery of the flat surface along a longitudinal axis of the shaft. The wall is sized to fit within an inlet opening of the pump. The wall includes a plurality of openings, forming an inlet through which molten metal can enter a base of the pump. The plurality of openings are small enough to prevent solid particles that are larger than a distance between an impeller of the pump and a pump chamber from entering the pump and large enough to prevent the pump from clogging.

22 Claims, 4 Drawing Sheets

MOLTEN METAL PUMP WITH PROTECTED INLET

TECHNICAL FIELD

The present invention relates to pumps for pumping molten metal and, in particular, to devices used to prevent objects from entering the inlet and jamming such pumps.

BACKGROUND ART

Pumps used for pumping molten metal typically include a motor carried by a motor mount, a shaft connected to the motor at one end, and an impeller connected to the other end of the shaft. Such pumps also include a base that includes an impeller chamber. The impeller is rotatable in the impeller chamber. Support members extend between the motor mount and the base. An optional volute member may be disposed in the impeller chamber. Pumps are designed with shaft bearings, impeller bearings and bearings in the base to prevent the shaft or impeller from contacting the base, which could damage the shaft or impeller. The shaft, impeller and support members for molten metal pumps are immersed in molten metals, such as aluminum, magnesium, copper, iron and alloys formed from these metals. The pump components that contact the molten metal are composed of refractory material, for example, graphite or silicon carbide.

Pumps commonly used to pump molten metal may be in the form of a transfer pump having a top discharge or a circulation pump having a bottom discharge, as disclosed in the pump publication "H.T.S. Pump Equation for the 80's" by High Temperature Systems, Inc., which is incorporated herein by reference in its entirety.

One problem that is often encountered with molten metal pumps is that they are damaged by solid impurities contained in the molten metal. The solid impurities include chunks of refractory brick and metal oxides, such as aluminum oxide. If a solid impurity becomes jammed between the impeller and the impeller chamber, the impeller or the shaft may be destroyed.

It is known in the art to place a plate above the inlet to the base of the pump to prevent some of the solid impurities from entering the base, thereby inhibiting jamming of the pump. U.S. Pat. No. 4,786,230 to Thut discloses a dual volute molten metal pump that includes a baffle plate above the inlet to the base of the pump for inhibiting chunks of material from entering the base of the pump. Pumps that include baffle plates are still subject to jamming, since relatively large solid impurities are still able to enter the opening of the base through a slot-like opening formed between the base and the baffle plate.

Filters have been designed to be placed over the inlet of a molten metal pump which are formed of a refractory with five pores that prevent all foreign material from entering the pump. These filters are cast, which limits their dimensional precision. Filters of this type are disclosed in U.S. Pat. Nos. 4,940,384; 5,078,572; and 5,286,163 to Amra et al. The Amra et al. patents disclose a molten metal pump that includes a filter that prevents ingestion of solid particles, as well as dross, in the molten metal. The filter has a low porosity, which requires the filter to have a large surface area to maintain a sufficient flow rate for the pump. Since the porosity of these types of filters is low, they tend to clog over time and, therefore, do not provide a workable solution.

It is known in the prior art to surround the shaft of the molten metal pump with a sleeve. The sleeve may include an opening that allows molten metal from the molten metal bath to enter the chamber of the molten metal pump. One example of this configuration is shown in FIG. 1 of U.S. Pat. No. 6,152,691 to Thut, which is incorporated herein by reference in its entirety.

The molten metal processing market demands a pump that does not jam, which would cause damage to the shaft and impeller of the pump. Accordingly, there is a need for a protected inlet for a molten metal pump that prevents the molten metal pump from jamming and avoids pump clogging.

DISCLOSURE OF INVENTION

The present invention concerns a protected inlet or guard for preventing jamming of a molten metal pump. The protected inlet or guard includes a flat surface and a wall that extends from the periphery of the flat surface. The flat surface includes a central opening that is sized to fit around the impeller shaft of the molten metal pump. The wall is sized to fit within an inlet opening of the pump. The wall includes openings through which molten metal can enter the inlet of the pump. The openings have a maximum dimension that is less than a specified distance from a wall of a pump chamber and greater than 0.250 inches.

In one embodiment, the flat surface is a circular plate and the wall is cylindrical. The guard may be constructed from a non-metallic, heat resistant material, such as a refractory material. The openings in the wall of the guard may be round and may have a diameter that is greater than or equal to ¼". In one embodiment, the size of the openings is between ¼" and ⅝". In one embodiment, the protected inlet or guard is machined. Disposal in the circular plate is a bearing ring that extends around the pump shaft.

A pump constructed in accordance with the present invention that is less prone to jamming includes a motor, a shaft, an impeller, a base, an inlet opening, a base opening, and a discharge passage. One end of the shaft is connected to the motor. The impeller is connected to the other end of the shaft. The base includes a chamber in which the impeller is rotatable. The impeller is positioned a specified distance from a wall of the chamber. The inlet includes a plurality of openings through which molten metal can enter the base. The plurality of openings are defined by a maximum dimension that is less than the specified distance, but greater than 0.250 inches. The base opening is in either the upper or lower portion of the base and receives the impeller. The base opening is disposed adjacent to the inlet. The molten metal enters the inlet of the base and leaves the chamber through the discharge passage.

In one embodiment, the chamber defined in the base is a spiral-shaped volute opening around the impeller which increases in size in a circumferential direction toward the discharge passage. In one embodiment, the pump includes a volute insert that is positioned within the chamber. In this embodiment, the specified distance is less than the minimum distance between the impeller and a wall of the chamber and less than the minimum distance between the impeller and the volute insert. In one embodiment, the impeller is positioned in the chamber so as to form a volute-shaped volume between the impeller and the chamber.

To pump molten metal with the pump of the present invention, the base is submerged in a bath of molten metal. The impeller on the end of the shaft is rotated in the chamber of the base. The rotation of the impeller causes molten metal to be drawn into the chamber through the plurality of openings that define the inlet of the pump. Large solid particles that are larger than the minimum distance are engaged by the inlet to prevent the large solid particles from entering the pump chamber. Small particles are drawn through the plurality of openings of the inlet into the pump chamber. Molten metal is passed through the outlet of the base. In one embodiment, the large particles engaged by the pump inlet are silicon particles.

Molten metal that is used for engine blocks, pistons and other related engine components now require increased silicon in the composition. The silicon is typically added in the form of pieces of about 3" by 5" in size. It takes a certain amount of time before the silicon pieces dissolve, much like dissolving sugar cubes, as opposed to granulated sugar, in coffee. The chunks of metallic silicon are brought into the base of the pump where they easily find their way around the opening formed by typical baffle plates, thereby resulting in jamming and destruction of pump components.

A pump constructed with the guard of the present invention prevents silicon pieces that are large enough to damage the pump from entering the inlet of the pump, thereby preventing jamming and destruction of the pump. When silicon is the cause of jamming of a pump, it is likely that the cause of the jam will not be discovered, because the silicon dissolves after the pump jams. Inspection of the pump would not reveal that silicon chunks were the cause of the jam.

The guard of the present invention effectively avoids jamming of the pump. Since the openings of the guard are much larger than typical filters, efficiency of the pump is enhanced. The improved efficiency produces a more homogeneous blend of molten metal and allows the temperature of the molten metal to be better maintained. Since the guard of the present invention can be machined to a great precision, it may include a bearing ring. The present invention also reduces the temperature of exhaust gases that are discharged by the pump of the present invention as a result of more efficient pumping.

Many additional features, advantages and a fuller understanding of the invention will be had from the accompanying drawings and detailed description that follows. It should be understood that the above summary of the invention describes the invention in broad terms, while the following detailed description of the preferred embodiments describes the invention more narrowly and presents preferred embodiments which should not be construed as necessary limitations of the broad invention as defined in the claims.

BEST MODE FOR CARRYING OUT THE INVENTION

Figure 1:
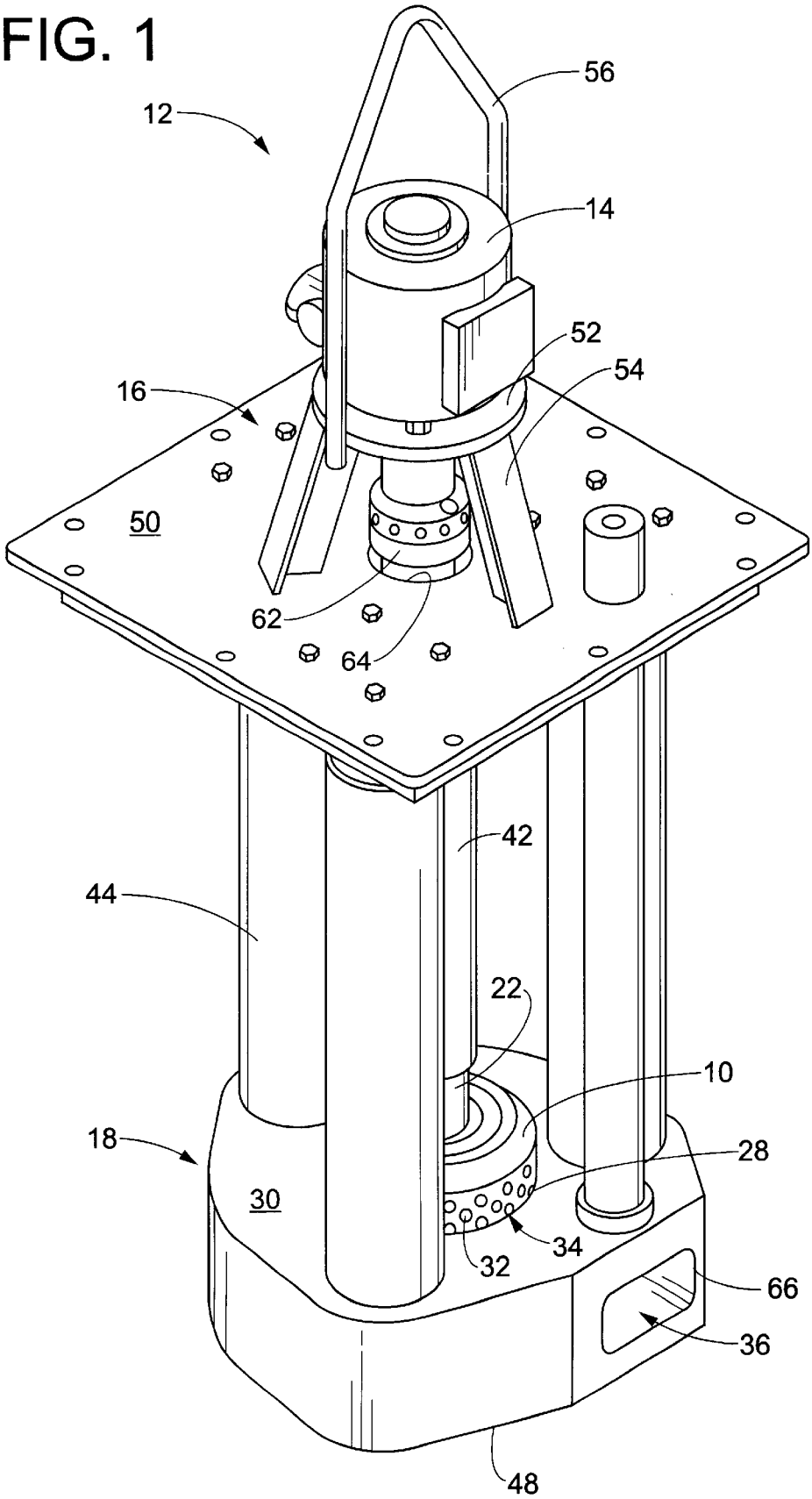
FIG. 1 is a perspective view of a pump for pumping molten metal, including a guard.
Figure 2:
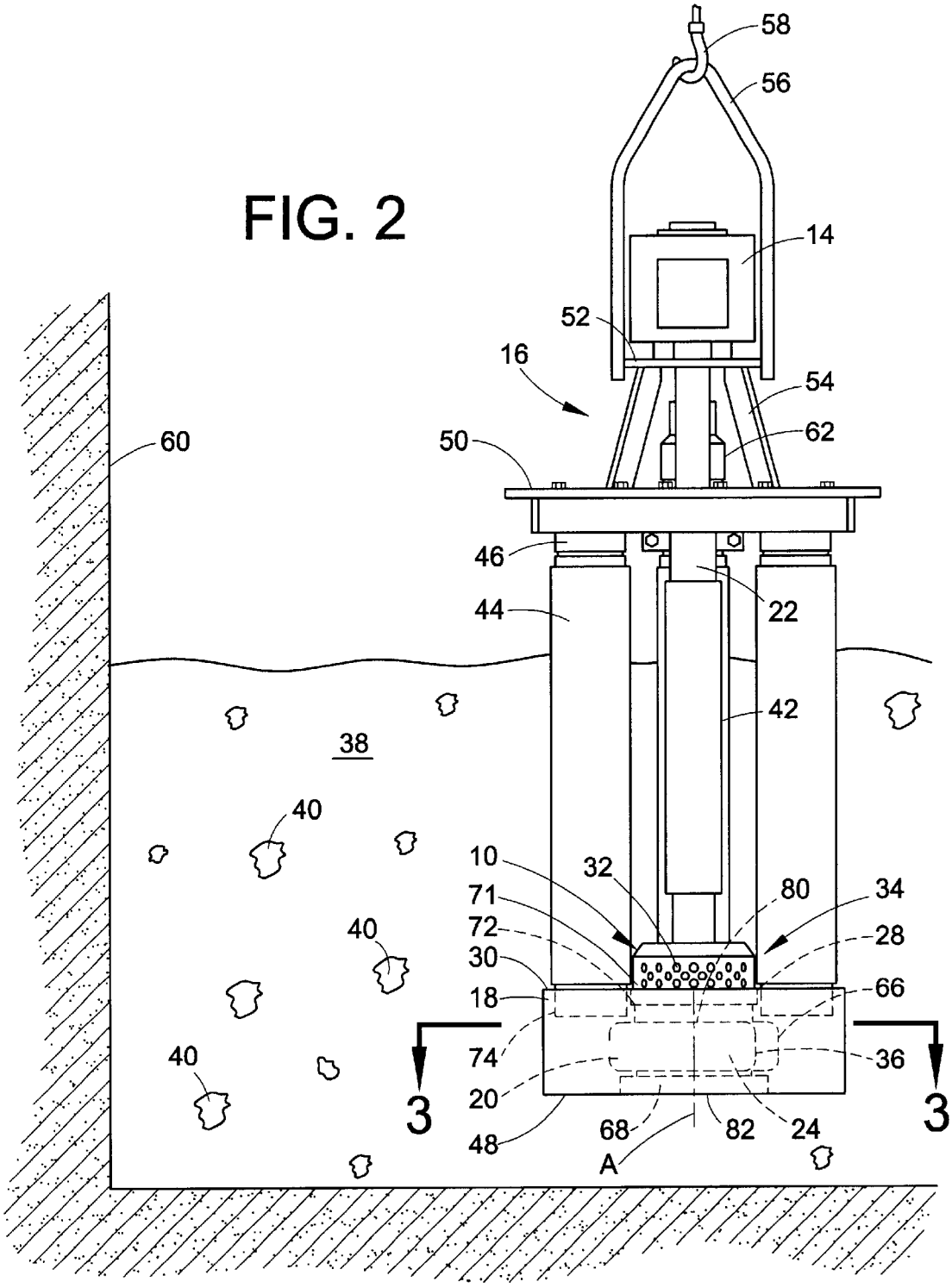
FIG. 2 is a side elevational view of a pump for pumping molten metal submerged in a bath of molten metal.
Figure 3:
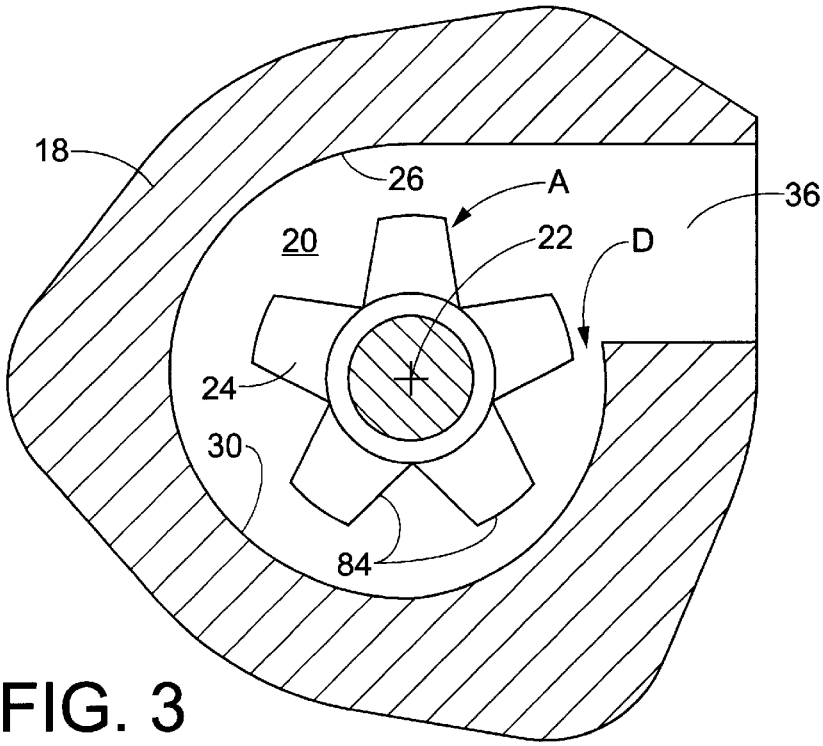
FIG. 3 is a cross-sectional view taken across lines 3—3 of FIG. 2.
Figure 4A:
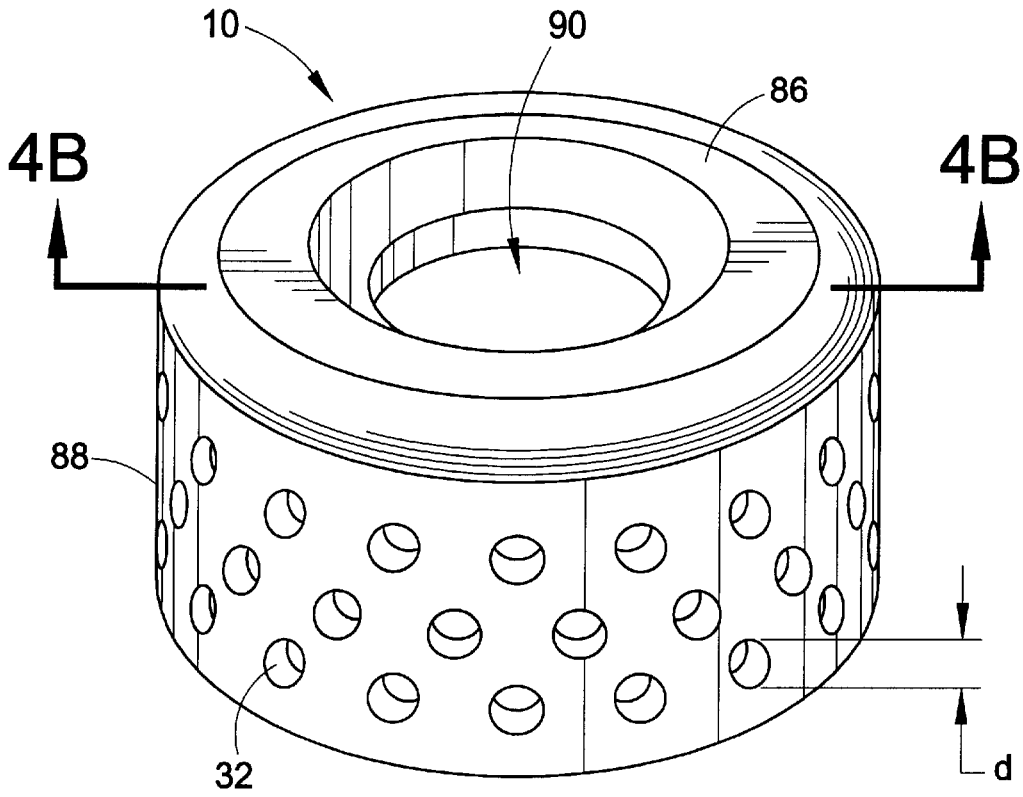
FIG. 4A is a perspective view of a guard.
Figure 4B:
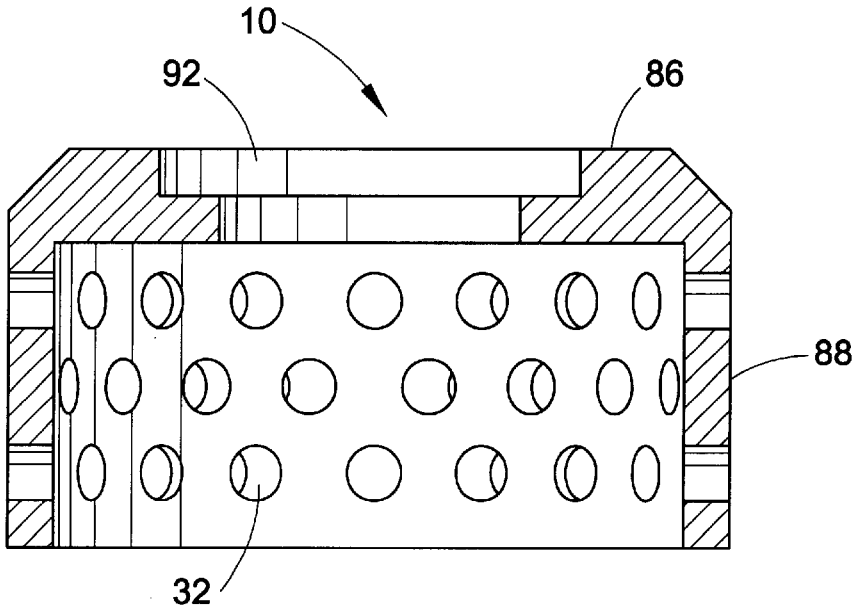
FIG. 4B is a cross-sectional view taken across lines 4B—4B of FIG. 4A.

The present invention is directed to an inlet protector or guard 10 for a molten metal pump 12 and to the pump itself which includes the guard. Referring to FIGS. 1–3, the illustrated pump is a top feed discharge pump generally designated by the reference numeral 12. The pump 12 includes a motor 14 mounted to a motor mount 16. A base 18 has an impeller chamber 20 formed therein (FIG. 2). A shaft 22 is connected to the motor 14 at one end. An impeller 24 is connected to the other end of the shaft 22. Referring to FIG. 3, the impeller 24 is rotatable in the impeller chamber 20. The impeller 24 is positioned a specified distance D from a wall 26 of the impeller chamber 20. In molten metal pumps the distance D is sometimes referred to as the cutwater. In the embodiment illustrated by FIGS. 1–3, the base 18 includes an opening 28 in an upper portion 30 of the base 18 that receives the impeller 24. The guard 10 is positioned within the opening 28 in the base 18. The guard 10 includes a plurality of openings 32. The plurality of openings 32 define the inlet 34 of the molten metal pump 12 through which molten metal 38 can enter the base. Referring to FIGS. 3, 4A and 4B, the largest dimension d of each of the holes 32 is smaller than the distance D from the wall 26 of the chamber to the impeller 20. The base 18 includes a discharge passage 36 through which the molten metal 38 may enter the base. The molten metal may include solid matter 40, such as refractory brick; metal oxide particles, such as aluminum oxide, silicon, as well as foreign objects.

Referring to FIGS. 1 and 2, a shaft sleeve 42 optionally surrounds the shaft 22. The shaft sleeve 42 and support posts 44 space the motor mount 16 and the base 18 apart. The shaft sleeve 42 and the support posts 44 have their lower ends fixed to the base 18. A quick release clamp 46 is carried by the motor mount 16. The quick release clamp 46 is of the type described in U.S. Pat. No. 5,716,195 to Thut entitled "Pumps for Pumping Molten Metal," issued Feb. 10, 1998, which is incorporated herein by reference in its entirety. The clamp 46 releasably clamps upper end portions of the shaft sleeve 42 and the support posts 44 to the motor mount 16. Individual clamps around the upper ends of each support member may also be employed. The motor mount 16 may be pivotally mounted, as disclosed in U.S. Pat. No. 5,842,832 to Thut, entitled "Pump for Pumping Molten Metal Having Cleaning and Repair Features," issued Dec. 1, 1998, which is incorporated herein by reference in its entirety.

It should be apparent that the invention is not limited to the illustrated pump construction, but rather may be used with any construction of transfer or circulation pump. For example, a pump having an inlet on the bottom surface 48 of the base 18 and a guard 10 disposed at the bottom of the base 18 could be employed. The present invention may also be used in a pump having more than one impeller, for example the guard 10 may be used in a dual volute impeller pump of the type described in U.S. Pat. No. 4,786,230 to Thut, entitled "Dual Volute Molten Metal Pump and Selective Outlet Discriminating Means," issued Nov. 22, 1988, which is incorporated herein by reference in its entirety.

The motor mount 16 comprises a flat mounting plate 50 and a motor support portion 52 that is spaced apart from the flat mounting plate 50 by legs 54. A hanger 56 may be attached to the motor mount 16. A hook 58 on the end of a cable is used to hoist the pump 12 into and out of a vessel or furnace 60 filled with molten metal 38. Various types of hangers 56 are suitable for use with the present invention, for example, those disclosed in the publication "H.T.S. Pump Equation for the 80's" by High Temperature Systems, Inc. The motor 14 is an air motor in the exemplary embodiment, and is directly mounted to the motor support portion 52 of the motor mount 16.

The shaft 22 is connected to the motor 14 by a coupling assembly 62 which is preferably constructed in the manner shown in U.S. Pat. No. 5,622,481 to Thut, entitled "Shaft Coupling for a Molten Metal Pump," issued Apr. 22, 1997, which is incorporated herein by reference in its entirety. An opening 64 in the mounting plate 50 allows the motor 14 to be connected to the shaft 22 with the coupling assembly 62.

In the embodiment illustrated by FIG. 2, the base 18 is spaced upward from the bottom of the vessel 60 by a few inches. The base 18 includes a molten metal inlet 34 defined by the plurality of openings 32 in the guard 10. The molten metal inlet 34 leads to the impeller chamber 20. The base 18 also includes a molten metal discharge passage 36 that leads to an outlet opening 66. A bottom opening 68 is formed in the lower surface of the base 18. In the exemplary embodiment, the bottom opening 68 is concentric with the shaft 22 and the opening 28 and receives the impeller 24. This configuration is known as a top feed type pump. A recess 71 (FIG. 2) surrounds the base inlet opening 28 and receives the guard 10. A shoulder 72 is formed in the base 18 around the inlet opening 28 and supports the guard 10. The guard 10 is cemented in place on the shoulder 72. The support posts 44 are cemented in place in openings 74 in the base 18.

The inlet protector or guard illustrated in FIGS. 4A and 4B includes a circular top portion or surface 86 and a cylindrical wall 88 that extends from the periphery of the top portion 86. The top portion 86 includes a central opening 90 that accepts the shaft 22. In the exemplary embodiment, the circular top portion 86 defines an annular recess 92 for a bearing ring (not shown). The bearing ring can be used in the circular top portion 86, because the guard 10 is machined in the exemplary embodiment. The bearing ring impacts the shaft 22 in the exemplary embodiment in a manner similar to known shaft bearings. The cylindrical wall 88 is sized to fit in the opening 28 in the base 18.

The cylindrical wall 88 includes the plurality of openings 32 that define the pump inlet 34 through which molten metal can enter the base. The openings 32 have a maximum dimension d that is less than the specified distance D from the wall 26 of the impeller chamber 20 to the impeller 24, often referred to as the cutwater (FIG. 3). The openings can have any shape. The maximum distance d is the maximum linear distance across the opening. For example, the distance d for a square-shaped opening is the distance between the diagonal corners of the square-shaped opening. In the exemplary embodiment, the openings 32 are between ¼" and 1" in diameter and are round. Openings that are less than ¼" tend to clog as the pump is used, especially when molten aluminum containing a significant amount of magnesium is being pumped. In the exemplary embodiment, the guard 10 is constructed from a non-metallic, heat resistant material, such as graphite or silicon carbide.

Figure 3B:
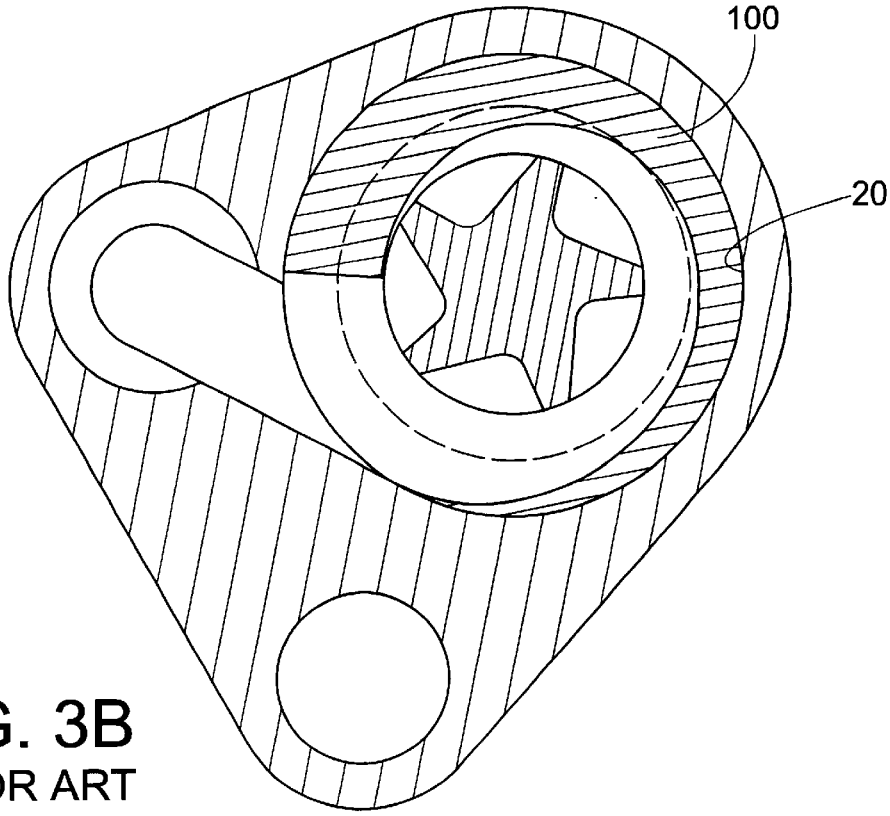
FIG. 3B PRIOR ART
FIG. 3B is a view similar to the view of FIG. 3 showing a volute member in an impeller chamber.

Referring to FIG. 3B, the guard 10 may be used in a pump that includes a volute 100 in one embodiment. A spiral shaped volute member 100 may be employed in the impeller chamber 20 to form a spiral shaped volute opening surrounding the impeller. When a volute 100 is used, the largest dimension d of the openings 32 is smaller than the minimum distance between the impeller and the volute 100. The minimum distance between the impeller and the volute 100 is often referred to as the cutwater.

The guard 10 allows some particles that are smaller than the distance D between the impeller 24 and the impeller chamber 20 or the distance between the impeller and the volute 100 to enter the impeller chamber 20, since these particles will not cause the pump to jam. Particles which are larger than the distance D between the impeller 24 and the impeller chamber 20 or the distance between the impeller and the volute 100 are prevented from entering the chamber 20 by the guard 10.

The impeller 24 is attached to one end portion of the shaft 22 by engagement of exterior threads formed on the shaft 22 with corresponding interior threads formed in the impeller 24. It should be readily understood to those skilled in the art that any connection between the shaft 22 and the impeller 24 can be used. For example, a keyway or pin arrangement may be used.

Referring to FIGS. 2 and 3, the impeller 24 has a generally cylindrically shaped body which includes a central rotational axis A, and first and second generally planar end faces 80, 82 that extend transverse to the central axis A. The impeller 24 is made of a non-metallic, heat resistant material, such as graphite and/or ceramic, suitable for operating in molten metal 38. The first end face 80 is a top face and the second end face 82 is a bottom face in the preferred embodiment. A plurality of side surfaces 84 extend generally parallel to the central axis "A" between the first and second faces 80, 82. In the exemplary embodiment, the impeller 24 is in a vaned impeller as is most clearly depicted in FIG. 3. It should be apparent to one skilled in the art that any impeller 24 could be used in the inventive molten metal pump 12 design. An example of one such impeller is described in U.S. Pat. No. 5,597,289 to Thut, entitled "Dynamically Balanced Pump Impeller," issued Jan. 7, 1997, which is herein incorporated by reference in its entirety.

The impeller 24 includes a mounting hole with interior threads. The mounting hole is centered on the central axis A of the impeller top face 80. The threads engage the external threads of the pump shaft 22.

To pump molten metal with a molten metal pump 12, including the guard 10 of the present invention, the base 18 of the pump 12 is submerged in a bath of molten metal 38. The motor 14 is activated to rotate the impeller 24 on the end of the shaft 22 in the chamber 20 of the base 18. The rotation of the impeller causes molten metal 38 to be drawn into the chamber 20 through the plurality of openings 32 in the guard 10 that define the inlet 34 to the base 18. Since the openings 32 in the guard 10 are smaller than the distance D between the impeller 24 and the impeller chamber 20, particles that are larger than the distance d between the impeller 24 and the impeller chamber 20 are engaged by the guard 10 to prevent the particles from entering the chamber. Some particles that are smaller than the openings 32 and, thus, smaller than the distance D between the impeller 24 and the impeller chamber 20 are drawn into the base 18. The molten metal 38, including any undissolved silicon particles are passed through the outlet opening 66 of the base 18.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

I claim:

1. A pump for pumping molten metal, comprising:

a) a motor;

b) a shaft having one end connected to the motor and extending along a longitudinal axis;

c) an impeller connected to the other end of the shaft;

d) a base having a chamber in which said impeller is rotatable, said impeller being positioned a specified distance from a wall of said chamber, said base including a base inlet opening;

e) a guard secured in said base inlet opening that defines an inlet including a plurality of openings through which molten metal can enter the base, said plurality of openings having a maximum dimension that is less than said specified distance and greater than 0.250 inches, said guard including a central opening that accepts said shaft;

f) a base opening in one of an upper and lower portion of said base that receives said impeller, said base opening being disposed adjacent said inlet; and g) a discharge passage in said base through which molten metal can leave said chamber.

2. The apparatus of claim 1 wherein said chamber comprises a wall forming a spiral shaped volute opening around the impeller which increases in size in a circumferential direction toward said discharge passage.

3. The apparatus of claim 1 wherein said impeller is positioned in said chamber to form a volute shaped volume between said impeller and said chamber.

4. The apparatus of claim 1 wherein said plurality of openings are round.

5. The apparatus of claim 1 wherein said plurality of openings are round and have a diameter greater than or equal to 0.375 inches.

6. The apparatus of claim 1 wherein said plurality of openings are round and have a diameters between 0.250 inches and 1.000 inches.

7. The apparatus of claim 1 wherein said inlet is defined by a guard having a plurality of openings, said guard disposed in said base opening.

8. The apparatus of claim 1 wherein said base includes an upper opening and a lower opening, said upper opening is concentric with said lower opening.

9. A pump for pumping molten metal, comprising:

a) a motor;

b) a shaft having one end connected to the motor and extending along a longitudinal axis;

c) an impeller connected to the other end of the shaft;

d) a base having a chamber in which said impeller is rotatable, e) a volute insert disposed in said chamber, said impeller, and said volute insert defining a specified distance that is the lesser of the minimum distance between the impeller and a wall of the chamber and a minimum distance between the impeller and the volute insert;

f) an inlet including a plurality of openings through which molten metal can enter the base, said plurality of openings having a maximum dimension that is less than said specified distance and greater than 0.250 inches;

g) a base opening in one of an upper and lower portion of said base that receives said impeller, said base opening being disposed adjacent said inlet; and h) a discharge passage in said base through which molten metal can leave said chamber.

10. A method of pumping molten metal comprising;

a) submerging a base of a pump in a bath of molten metal;

b) rotating an impeller on an end of a shaft in a chamber of said base;

c) drawing molten metal into said chamber through an inlet including a plurality of openings that include a maximum dimension that is smaller than a minimum distance between said impeller and a wall of said chamber and larger than 0.250 inches;

d) engaging large solid particles that are larger than said minimum distance with said inlet to prevent said large solid particles from entering said chamber;

e) drawing small particles that are less than 0.250 inches into said chamber through said inlet; and f) passing said molten metal through an outlet of said base.

11. The method of claim 10 wherein said large particles comprise silicon.

12. The method of claim 10 wherein particles having a smallest dimension that is less than 0.375 inches are drawn into said chamber.

13. The method of claim 10 wherein a large particle is engaged by a periphery of a round opening in said inlet.

14. A guard for preventing jamming of a molten metal pump which comprises a motor, a shaft having one end connected to the motor and extending along a longitudinal axis, an impeller connected to the other end of the shaft, a base having a chamber in which said impeller is rotatable, a base inlet opening, a base opening in one of an upper and lower portion of said base that receives said impeller and an outlet opening in said base through which molten metal can leave the base, comprising:

a) a flat surface including a central opening that accepts said shaft; and, b) a wall extending from a periphery of said flat surface, said wall sized to fit within said base inlet opening, said wall including a plurality of openings through which molten metal can enter the base, said plurality of openings having a maximum dimension that is less than a minimum distance from an impeller to a wall of a pump chamber, and greater than 0.250 inches.

15. The guard of claim 14 wherein said flat surface is circular and said wall is cylindrical.

16. The guard of claim 14 wherein said guard is constructed from a non-metallic, heat resistant material.

17. The guard of claim 14 wherein said specified distance is the less than one of a minimum distance between the impeller and the wall of the chamber and a minimum distance between the impeller and a volute insert.

18. The guard of claim 14 wherein said specified distance is the minimum distance between the impeller and a volute wall of the chamber.

19. The guard of claim 14 wherein said plurality of openings are round.

20. The guard of claim 14 wherein said plurality of openings are round and have a diameter greater than or equal to 0.250 inches.

21. The guard of claim 14 wherein said plurality of openings are round and have diameters between 0.250 inches to 1.000 inch.

22. The guard of claim 14 wherein said guard includes an annular recess for a bearing ring extending from said flat surfaces.

* * * * *